US010131853B2

(12) United States Patent
Velasco Pelaez et al.

(10) Patent No.: US 10,131,853 B2
(45) Date of Patent: Nov. 20, 2018

(54) PROCESS FOR PRODUCING BTX FROM A MIXED HYDROCARBON SOURCE USING PYROLYSIS

(71) Applicants: SAUDI BASIC INDUSTRIES CORPORATION, Riyadh (SA); SABIC GLOBAL TECHNOLOGIES B.V., Bergen op Zoom (NL)

(72) Inventors: Raul Velasco Pelaez, Geleen (NL); Ravichander Narayanaswamy, Bangalore (IN); Vijayanand Rajagopalan, Bangalore (IN); Arno Johannes Maria Oprins, Geleen (NL); Andrew Mark Ward, Wilton Centre (GB); Egidius Jacoba Maria Schaerlaeckens, Geleen (NL); Joris Van Willigenburg, Geleen (NL)

(73) Assignees: SAUDI BASIC INDUSTRIES CORPORATION, Riyadh (SA); SABIC GLOBAL TECHNOLOGIES B.V., Bergen Op Zoom (NL)

( * ) Notice: Subject to any disclaimer, the term of this patent is extended or adjusted under 35 U.S.C. 154(b) by 0 days.

(21) Appl. No.: 15/120,172

(22) PCT Filed: Dec. 10, 2014

(86) PCT No.: PCT/EP2014/077242
§ 371 (c)(1),
(2) Date: Aug. 19, 2016

(87) PCT Pub. No.: WO2015/128016
PCT Pub. Date: Sep. 3, 2015

(65) Prior Publication Data

US 2017/0058210 A1 Mar. 2, 2017

(30) Foreign Application Priority Data

Feb. 25, 2014 (EP) ..... 14156610

(51) Int. Cl.
*C10G 57/00* (2006.01)
*C10G 69/00* (2006.01)
*C10G 69/06* (2006.01)

(52) U.S. Cl.
CPC ..... *C10G 57/00* (2013.01); *C10G 69/00* (2013.01); *C10G 69/06* (2013.01); *C10G 2400/30* (2013.01)

(58) Field of Classification Search
None
See application file for complete search history.

(56) References Cited

U.S. PATENT DOCUMENTS 3,256,176 A 6/1966 Mills
3,556,983 A 1/1971 Kronig
(Continued)

FOREIGN PATENT DOCUMENTS

CN 101987969 3/2011
CN 103097496 5/2013
(Continued)

OTHER PUBLICATIONS

Alfke et al., "Oil Refining", Ullmann's Encyclopedia of Industrial Chemistry, 2007, 55 pages.
(Continued)

*Primary Examiner* — Tam M Nguyen
(74) *Attorney, Agent, or Firm* — Norton Rose Fulbright US LLP

(57) ABSTRACT

The present invention relates to a process for producing BTX comprising pyrolysis, aromatic ring opening and BTX recovery. Furthermore, the present invention relates to a process installation to convert a pyrolysis feedstream into BTX comprising a pyrolysis unit, an aromatic ring opening unit and a BTX recovery unit.

20 Claims, 3 Drawing Sheets

(56) References Cited

U.S. PATENT DOCUMENTS

| | | | |
|---|---|---|---|
| 4,056,575 | A | 11/1977 | Gregory et al. |
| 4,157,356 | A | 6/1979 | Bulford et al. |
| 4,180,689 | A | 12/1979 | Davies et al. |
| 4,789,457 | A | 12/1988 | Fischer et al. |
| 6,153,087 | A | 11/2000 | Bigeard et al. |
| 6,270,654 | B1 | 8/2001 | Colyar et al. |
| 7,019,188 | B2 | 3/2006 | Smith et al. |
| 7,214,308 | B2 | 5/2007 | Colyar |
| 7,513,988 | B2 | 4/2009 | Oballa et al. |
| 7,704,377 | B2 | 4/2010 | Duddy et al. |
| 7,938,952 | B2 | 5/2011 | Colyar et al. |
| 8,926,824 | B2 | 1/2015 | Morel |
| 9,005,430 | B2 | 4/2015 | Fournier et al. |
| 9,840,674 | B2 | 12/2017 | Weiss et al. |
| 2004/0004022 | A1 | 1/2004 | Stell et al. |
| 2007/0037828 | A1 | 2/2007 | Gebauer et al. |
| 2008/0093262 | A1 | 4/2008 | Gragnani et al. |
| 2009/0173665 | A1 | 7/2009 | Zhou et al. |
| 2009/0173666 | A1 | 7/2009 | Zhou et al. |
| 2013/0197289 | A1 | 8/2013 | Bourane et al. |
| 2014/0299515 | A1 | 10/2014 | Weiss et al. |
| 2016/0122666 | A1 | 5/2016 | Weiss et al. |

FOREIGN PATENT DOCUMENTS

| | | | |
|---|---|---|---|
| CN | 103121897 | | 5/2013 |
| WO | 0159033 | A1 | 8/2001 |
| WO | 0244306 | A1 | 6/2002 |
| WO | 2004013095 | A2 | 2/2004 |
| WO | 2006137615 | A1 | 12/2006 |
| WO | 2007055488 | A1 | 5/2007 |
| WO | 2013182534 | A1 | 12/2013 |
| WO | WO 2016/146326 | | 9/2016 |

OTHER PUBLICATIONS

Encyclopedia of Hydrocarbons, "Aromatics: Aromatics production and use", 2006, vol. II, Refining and Petrochemicals, Chapter 10.6, pp. 591-614.

International Search Report for International Application No: PCT/EP2014/077242; dated Jan. 19, 2015, 5 pages.

IUPAC, Compendium of Chemical Terminology, Gold Book, 1997, 2nd edition, 1670 pages.

Nagamori et al., "Converting light hydrocarbons containing olefins to aromatics (Alpha Process)", Microporous and Mesoporous Materials, 1998, vol. 21, pp. 439-445.

Speight, "Petroleum Refinery Process", Kirk-Othmer Encyclopedia of Chemical Technology, 2007, vol. 18, pp. 1-49.

Ullmann's Encyclopedia of Industrial Chemistry, 2012, vol. 13, Chapter "Ethylene", p. 512.

Ullmann's Encyclopedia of Industrial Chemistry, 2012, vol. 6, Chapter "Butadiene", pp. 388-390.

Written Opinion of the International Search Report for International Application No. PCT/EP2014/077242; dated Jan. 19, 2015, 4 pages.

PROCESS FOR PRODUCING BTX FROM A MIXED HYDROCARBON SOURCE USING PYROLYSIS

FIELD OF THE INVENTION

CROSS REFERENCE TO RELATED APPLICATIONS

This application is a 371 of International Application No. PCT/EP2014/077242, filed Dec. 10, 2014, which claims priority to European Application No. 14156610.9, filed Feb. 25, 2014 both which are incorporated herein by reference in their entirety.

The present invention relates to a process for producing BTX comprising pyrolysis, aromatic ring opening and BTX recovery. Furthermore, the present invention relates to a process installation to convert a pyrolysis feedstream into BTX comprising a pyrolysis unit, an aromatic ring opening unit and a BTX recovery unit.

BACKGROUND OF THE INVENTION

It has been previously described that the production of light olefin hydrocarbons from a hydrocarbon feedstock can be increased by a process comprising the steps of: feeding a hydrocarbon feedstock into a pyrolysis furnace to conduct a pyrolysis reaction; separating reaction products, which are generated from the pyrolysis reaction, into a stream containing hydrogen and C4 or lower hydrocarbons, and a stream containing C5+ hydrocarbons, through a compression and fractionation process; recovering hydrogen, and C2, C3 and C4 olefin and paraffin hydrocarbons, respectively from the stream containing hydrogen and C4 or lower hydrocarbons; separating pyrolysis gasolines and a C9+ hydrocarbon-containing fraction from the stream containing C5+ hydrocarbons, using hydrogenation and separation processes; feeding a mixture of the separated pyrolysis gasolines, a hydrocarbon feedstock, and hydrogen into at least one reaction area; converting the mixture in the presence of a catalyst in the reaction area into an aromatic hydrocarbon compound which is rich in benzene, toluene, and xylene through dealkylation/transalkylation reactions, and into a non-aromatic hydrocarbon compound which is rich in liquefied petroleum gas through a hydrocracking reaction; separating reaction products of the mixture converting step into an overhead stream, which contains hydrogen, methane, ethane, and liquefied petroleum gas, and a bottom stream, which contains aromatic hydrocarbon compounds, and a small amount of hydrogen and non-aromatic hydrocarbon compounds, using a gas-liquid separation process; circulating the overhead stream into the compression and fractionation process; and recovering the aromatic hydrocarbon compounds from the bottom stream; see e.g. US 20060287561 A1. In the process described in US 20060287561 A1, the C9+ hydrocarbon-containing fraction produced by pyrolysis is separated and purged. A major drawback of the process of US 20060287561 A1 is that the aromatics yield is relatively low.

OBJECTS OF THE INVENTION

It was an object of the present invention to provide a process for producing BTX from a mixed hydrocarbon stream having an improved yield of high-value petrochemical products such as BTX.

SUMMARY OF THE INVENTION

The solution to the above problem is achieved by providing the embodiments as described herein below and as characterized in the claims. Accordingly, the present invention provides a process for producing BTX comprising:

(a) subjecting a pyrolysis feedstream comprising hydrocarbons to pyrolysis to produce pyrolysis gasoline and C9+ hydrocarbons;

(b) subjecting C9+ hydrocarbons to aromatic ring opening to produce BTX; and (c) recovering BTX from pyrolysis gasoline.

In the context of the present invention, it was surprisingly found that the yield of high-value petrochemical products, such as BTX can be improved by using the improved process as described herein.

BRIEF DESCROPTION OF THE FIGURES

DETAILED DESCRIPTION

Figure 1:
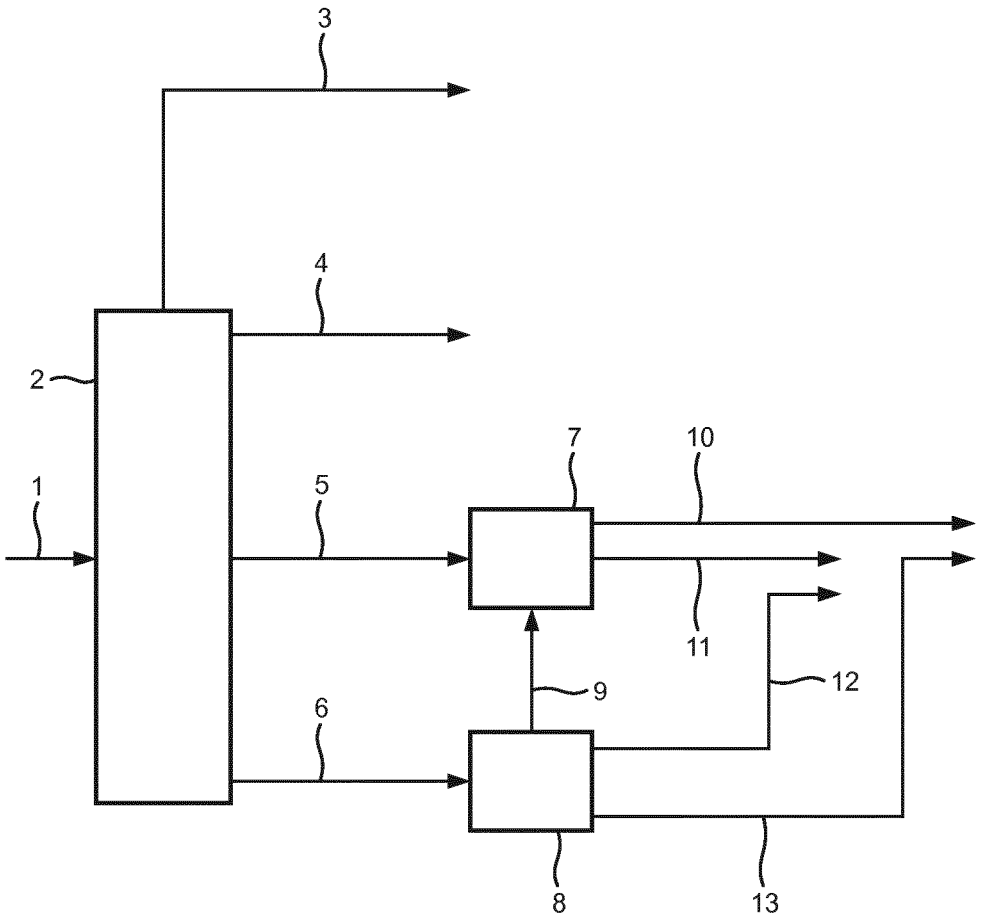
FIG. 1 is a flow scheme illustrating of an embodiment according to the present invention.

In the process of the present invention, any hydrocarbon composition that is suitable as a feed for pyrolysis can be used.

Particularly suitable pyrolysis feedstreams may be selected from the group consisting of naphtha, gas condensate, kerosene, gasoils, and (hydro)waxes. However, the process of the present invention may also employ pyrolysis of crude oil as described in US 2013/0197289 A1 and US 2004/0004022 A1. The term "crude oil" as used herein refers to the petroleum extracted from geologic formations in its unrefined form. The term crude oil will also be understood to include crude oil which has been subjected to water-oil separations and/or gas-oil separation and/or desalting and/or stabilization. Particularly preferred crude oil that is used as a pyrolysis feedstream in the process of the present invention is selected from the group consisting of Arab Extra Light crude oil, Arab Super Light crude oil and shale oil. In case crude oil is used as a feed, it may be specifically subjected to solvent deasphalting before subjecting to pyrolysis.

Preferably, the pyrolysis feedstream comprises naphtha, preferably paraffinic naphtha or straight run naphtha. Preferably the pyrolysis feedstream has an aromatic hydrocarbon content of less than 20 wt % as measured according to ASTM D5443 standard. It was found that when a pyrolysis feedstream is used having an aromatic hydrocarbon content of less than 20 wt % as measured according to ASTM D5443 standard, the hydrogen balance of the process of the present invention is improved, or even in balance. When the process of the present invention is in hydrogen balance, sufficient hydrogen is produced in the hydrogen producing unit operations of the present invention to satisfy the total hydrogen used in the hydrogen consuming unit operations.

The terms naphtha and gasoil are used herein having their generally accepted meaning in the field of petroleum refinery processes; see Alfke et al. (2007) Oil Refining, Ullmann's Encyclopedia of Industrial Chemistry and Speight (2005) Petroleum Refinery Processes, Kirk-Othmer Encyclopedia of Chemical Technology. In this respect, it is to be noted that there may be overlap between different crude oil fractions due to the complex mixture of the hydrocarbon compounds comprised in the crude oil and the technical limits to the crude oil distillation process. Preferably, the term "naphtha" as used herein relates to the petroleum fraction obtained by crude oil distillation having a boiling point range of about 20-200° C., more preferably of about 30-190° C. Preferably, light naphtha is the fraction having a boiling point range of about 20-100° C., more preferably of about 30-90° C. Heavy naphtha preferably has a boiling point range of about 80-200° C., more preferably of about 90-190° C. Preferably, the term "kerosene" as used herein relates to the petroleum fraction obtained by crude oil distillation having a boiling point range of about 180-270° C., more preferably of about 190-260° C. Preferably, the term "gasoil" as used herein relates to the petroleum fraction obtained by crude oil distillation having a boiling point range of about 250-360° C., more preferably of about 260-350° C.

The process of the present invention involves pyrolysis in which saturated hydrocarbons comprised in the pyrolysis feedstream are broken down into smaller, often unsaturated, hydrocarbons. A very common process for pyrolysis of hydrocarbons involves "steam cracking". As used herein, the term "steam cracking" relates to a petrochemical process in which saturated hydrocarbons, such as ethane, are converted into unsaturated hydrocarbons such as ethylene. In steam cracking the gasified pyrolysis feedstream is diluted with steam and briefly heated in a furnace without the presence of oxygen. Typically, the reaction temperature is 750-900° C. and the reaction is only allowed to take place very briefly, usually with residence times of 50-1000 milliseconds. Preferably, a relatively low process pressure is to be selected of atmospheric up to 175 kPa gauge. The steam to hydrocarbon weight ratio preferably is 0.1-1.0, more preferably 0.3-0.5. After the cracking temperature has been reached, the gas is quickly quenched to stop the reaction in a transfer line heat exchanger or inside a quenching header using quench oil. Steam cracking results in the slow deposition of coke, a form of carbon, on the reactor walls. Decoking requires the furnace to be isolated from the process and then a flow of steam or a steam/air mixture is passed through the furnace coils. This converts the hard solid carbon layer to carbon monoxide and carbon dioxide. Once this reaction is complete, the furnace is returned to service. The products produced by steam cracking depend on the composition of the feed, the hydrocarbon to steam ratio and on the cracking temperature and furnace residence time.

Preferably, the pyrolysis comprises heating the pyrolysis feedstream in the presence of steam to temperature of 750-900° C. with residence time of 50-1000 milliseconds at a pressure of atmospheric to 175 kPa gauge.

The term "alkane" or "alkanes" is used herein having its established meaning and accordingly describes acyclic branched or unbranched hydrocarbons having the general formula $C_nH_{2n+2}$, and therefore consisting entirely of hydrogen atoms and saturated carbon atoms; see e.g. IUPAC. Compendium of Chemical Terminology, 2nd ed. (1997). The term "alkanes" accordingly describes unbranched alkanes ("normal-paraffins" or "n-paraffins" or "n-alkanes") and branched alkanes ("iso-paraffins" or "iso-alkanes") but excludes naphthenes (cycloalkanes).

The term "aromatic hydrocarbons" or "aromatics" is very well known in the art. Accordingly, the term "aromatic hydrocarbon" relates to cyclically conjugated hydrocarbon with a stability (due to delocalization) that is significantly greater than that of a hypothetical localized structure (e.g. Kekule structure). The most common method for determining aromaticity of a given hydrocarbon is the observation of diatropicity in the 1H NMR spectrum, for example the presence of chemical shifts in the range of from 7.2 to 7.3 ppm for benzene ring protons.

The terms "naphthenic hydrocarbons" or "naphthenes" or "cycloalkanes" is used herein having its established meaning and accordingly describes saturated cyclic hydrocarbons.

The term "olefin" is used herein having its well-established meaning. Accordingly, olefin relates to an unsaturated hydrocarbon compound containing at least one carbon-carbon double bond. Preferably, the term "olefins" relates to a mixture comprising two or more of ethylene, propylene, butadiene, butylene-1, isobutylene, isoprene and cyclopentadiene.

The term "LPG" as used herein refers to the well-established acronym for the term "liquefied petroleum gas". LPG generally consists of a blend of C2-C4 hydrocarbons i.e. a mixture of ethane, propane and butanes and, depending on the source, also ethylene, propylene and butylenes.

As used herein, the term "C# hydrocarbons", wherein "#" is a positive integer, is meant to describe all hydrocarbons having # carbon atoms. Moreover, the term "C#+ hydrocarbons" is meant to describe all hydrocarbon molecules having # or more carbon atoms. Accordingly, the term "C9+ hydrocarbons" is meant to describe a mixture of hydrocarbons having 9 or more carbon atoms. The term "C9+ alkanes" accordingly relates to alkanes having 9 or more carbon atoms.

The terms light-distillate, middle-distillate and heavy-distillate are used herein having their generally accepted meaning in the field of petrochemical processes; see Speight, J. G. (2005) loc.cit. In this respect, it is to be noted that there may be overlap between different distillation fractions due to the complex mixture of the hydrocarbon compounds comprised in the product stream produced by refinery or petrochemical unit operations and the technical limits to the distillation process used to separate the different fractions. Preferably, a "light-distillate" is a hydrocarbon distillate obtained in a refinery or petrochemical process having a boiling point range of about 20-200° C., more preferably of about 30-190° C. The "light-distillate" is often relatively rich in aromatic hydrocarbons having one aromatic ring. Preferably, a "middle-distillate" is a hydrocarbon distillate obtained in a refinery or petrochemical process having a boiling point range of about 180-360° C., more preferably of about 190-350° C. The "middle-distillate" is relatively rich in aromatic hydrocarbons having two aromatic rings. Preferably, a "heavy-distillate" is a hydrocarbon distillate obtained in a refinery or petrochemical process having a boiling point of more than about 340° C., more preferably of more than about 350° C. The "heavy-distillate" is relatively rich in hydrocarbons having more than 2 aromatic rings. Accordingly, a refinery or petrochemical process-derived distillate is obtained as the result of a chemical conversion followed by a fractionation, e.g. by distillation or by extraction, which is in contrast to a crude oil fraction. Accordingly, a refinery or petrochemical process-derived distillate is obtained as the result of a chemical conversion followed by a fractionation, e.g. by distillation or by extraction, which is in contrast to a crude oil fraction.

The process of the present invention involves aromatic ring opening, which comprises contacting the C9+ hydrocarbons in the presence of hydrogen with an aromatic ring opening catalyst under aromatic ring opening conditions. The process conditions useful in aromatic ring opening, also described herein as "aromatic ring opening conditions", can be easily determined by the person skilled in the art; see e.g. U.S. Pat. No. 3,256,176, U.S. Pat. No. 4,789,457 and U.S. Pat. No. 7,513,988.

The term "aromatic ring opening" is used herein in its generally accepted sense and thus may be defined as a process to convert a hydrocarbon feed that is relatively rich in hydrocarbons having condensed aromatic rings, such as C9+ hydrocarbons, to produce a product stream comprising a light-distillate that is relatively rich in BTX (ARO-derived gasoline) and preferably LPG. Such an aromatic ring opening process (ARO process) is for instance described in U.S. Pat. No. 3,256,176 and U.S. Pat. No. 4,789,457. Such processes may comprise of either a single fixed bed catalytic reactor or two such reactors in series together with one or more fractionation units to separate desired products from unconverted material and may also incorporate the ability to recycle unconverted material to one or both of the reactors. Reactors may be operated at a temperature of 200-600° C., preferably 300-400° C., a pressure of 3-35 MPa, preferably 5 to 20 MPa together with 5-20 wt-% of hydrogen (in relation to the hydrocarbon feedstock), wherein said hydrogen may flow co-current with the hydrocarbon feedstock or counter current to the direction of flow of the hydrocarbon feedstock, in the presence of a dual functional catalyst active for both hydrogenation-dehydrogenation and ring cleavage, wherein said aromatic ring saturation and ring cleavage may be performed. Catalysts used in such processes comprise one or more elements selected from the group consisting of Pd, Rh, Ru, Ir, Os, Cu, Co, Ni, Pt, Fe, Zn, Ga, In, Mo, W and V in metallic or metal sulphide form supported on an acidic solid such as alumina, silica, alumina-silica and zeolites. In this respect, it is to be noted that the term "supported on" as used herein includes any conventional way to provide a catalyst which combines one or more elements with a catalytic support. By adapting either single or in combination the catalyst composition, operating temperature, operating space velocity and/or hydrogen partial pressure, the process can be steered towards full saturation and subsequent cleavage of all rings or towards keeping one aromatic ring unsaturated and subsequent cleavage of all but one ring. In the latter case, the ARO process produces a light-distillate ("ARO-gasoline") which is relatively rich in hydrocarbon compounds having one aromatic and or naphthenic ring. In the context of the present invention, it is preferred to use an aromatic ring opening process that is optimized to keep one aromatic or naphthenic ring intact and thus to produce a light-distillate which is relatively rich in hydrocarbon compounds having one aromatic or naphthenic ring.

A further aromatic ring opening process (ARO process) is described in U.S. Pat. No. 7,513,988. Accordingly, the ARO process may comprise aromatic ring saturation at a temperature of 100-500° C., preferably 200-500° C., more preferably 300-500° C., a pressure of 2-10 MPa together with 1-30 wt-%, preferably 5-30 wt-% of hydrogen (in relation to the hydrocarbon feedstock) in the presence of an aromatic hydrogenation catalyst and ring cleavage at a temperature of 200-600° C., preferably 300-400° C., a pressure of 1-12 MPa together with 1-20 wt-% of hydrogen (in relation to the hydrocarbon feedstock) in the presence of a ring cleavage catalyst, wherein said aromatic ring saturation and ring cleavage may be performed in one reactor or in two consecutive reactors. The aromatic hydrogenation catalyst may be a conventional hydrogenation/hydrotreating catalyst such as a catalyst comprising a mixture of Ni, W and Mo on a refractory support, typically alumina. The ring cleavage catalyst comprises a transition metal or metal sulphide component and a support. Preferably the catalyst comprises one or more elements selected from the group consisting of Pd, Rh, Ru, Ir, Os, Cu, Co, Ni, Pt, Fe, Zn, Ga, In, Mo, W and V in metallic or metal sulphide form supported on an acidic solid such as alumina, silica, alumina-silica and zeolites. In this respect, it is to be noted that the term "supported on" as used herein includes any conventional way of to provide a catalyst which combines one or more elements with a catalyst support. By adapting either single or in combination the catalyst composition, operating temperature, operating space velocity and/or hydrogen partial pressure, the process can be steered towards full saturation and subsequent cleavage of all rings or towards keeping one aromatic ring unsaturated and subsequent cleavage of all but one ring. In the latter case, the ARO process produces a light-distillate ("ARO-gasoline") which is relatively rich in hydrocarbon compounds having one aromatic ring. In the context of the present invention, it is preferred to use an aromatic ring opening process that is optimized to keep one aromatic ring intact and thus to produce a light-distillate which is relatively rich in hydrocarbon compounds having one aromatic ring.

Preferably, the aromatic ring opening comprises contacting the C9+ hydrocarbons in the presence of hydrogen with an aromatic ring opening catalyst under aromatic ring opening conditions, wherein the aromatic ring opening catalyst comprises a transition metal or metal sulphide component and a support, preferably comprising one or more elements selected from the group consisting of Pd, Rh, Ru, Ir, Os, Cu, Co, Ni, Pt, Fe, Zn, Ga, In, Mo, W and V in metallic or metal sulphide form supported on an acidic solid, preferably selected from the group consisting of alumina, silica, alumina-silica and zeolites and wherein the aromatic ring opening conditions comprise a temperature of 100-600° C., a pressure of 1-12 MPa. Preferably, the aromatic ring opening conditions further comprise the presence and the presence of 5-30 wt-% of hydrogen (in relation to the hydrocarbon feedstock).

Preferably, the aromatic ring opening catalyst comprises an aromatic hydrogenation catalyst comprising one or more elements selected from the group consisting of Ni, W and Mo on a refractory support, preferably alumina; and a ring cleavage catalyst comprising a transition metal or metal sulphide component and a support, preferably comprising one or more elements selected from the group consisting of Pd, Rh, Ru, Ir, Os, Cu, Co, Ni, Pt, Fe, Zn, Ga, In, Mo, W and V in metallic or metal sulphide form supported on an acidic solid, preferably selected from the group consisting of alumina, silica, alumina-silica and zeolites, and wherein the conditions for aromatic hydrogenation comprise a temperature of 100-500° C., preferably 200-500° C., more preferably 300-500° C., a pressure of 2-10 MPa and the presence of 1-30 wt-%, preferably 5-30 wt-%, of hydrogen (in relation to the hydrocarbon feedstock) and wherein the ring cleavage comprises a temperature of 200-600° C., preferably 300-400° C., a pressure of 1-12 MPa and the presence of 1-20 wt-% of hydrogen (in relation to the hydrocarbon feedstock).

The process of the present invention involves recovery of BTX from a mixed hydrocarbon stream comprising aromatic hydrocarbons, such as pyrolysis gasoline. Any conventional means for separating BTX from a mixed hydrocarbons stream may be used to recover the BTX. One such suitable means for BTX recovery involves conventional solvent extraction. The pyrolysis gasoline and light-distillate may be subjected to "gasoline treatment" prior to solvent extraction. As used herein, the term "gasoline treatment" or "gasoline hydrotreatment" relates to a process wherein an unsaturated and aromatics-rich hydrocarbon feedstream, such as pyrolysis gasoline, is selectively hydrotreated so that the carbon-carbon double bonds of the olefins and di-olefins comprised in said feedstream are hydrogenated; see also U.S. Pat. No. 3,556,983. Conventionally, a gasoline treatment unit may include a first-stage process to improve the stability of the aromatics-rich hydrocarbon stream by selectively hydrogenating diolefins and alkenyl compounds thus making it suitable for further processing in a second stage. The first stage hydrogenation reaction is carried out using a hydrogenation catalyst commonly comprising Ni and/or Pd, with or without promoters, supported on alumina in a fixed-bed reactor. The first stage hydrogenation is commonly performed in the liquid phase comprising a process inlet temperature of 200° C. or less, preferably of 30-100° C. In a second stage, the first-stage hydrotreated aromatics-rich hydrocarbon stream may be further processed to prepare a feedstock suitable for aromatics recovery by selectively hydrogenating the olefins and removing sulfur via hydrodesulfurization. In the second stage hydrogenation a hydrogenation catalyst is commonly used comprising elements selected from the group consisting of Ni, Mo, Co, W and Pt, with or without promoters, supported on alumina in a fixed-bed reactor, wherein the catalyst is in a sulfide form. The process conditions generally comprise a process temperature of 200-400° C., preferably of 250-350° C. and a pressure of 1-3.5 MPa, preferably 2-3.5 MPa gauge. The aromatics-rich product produced by the GTU is then further subject to BTX recovery using conventional solvent extraction. In case the aromatics-rich hydrocarbon mixture that is to be subjected to the gasoline treatment is low in diolefins and alkenyl compounds, the aromatics-rich hydrocarbon stream can be directly subjected to the second stage hydrogenation or even directly subjected to aromatics extraction. Preferably, the gasoline treatment unit is a hydrocracking unit as described herein below that is suitable for converting a feedstream that is rich in aromatic hydrocarbons having one aromatic ring into purified BTX.

The product produced in the process of the present invention is BTX. The term "BTX" as used herein relates to a mixture of benzene, toluene and xylenes. Preferably, the product produced in the process of the present invention comprises further useful aromatic hydrocarbons such as ethylbenzene. Accordingly, the present invention preferably provides a process for producing a mixture of benzene, toluene xylenes and ethylbenzene ("BTXE"). The product as produced may be a physical mixture of the different aromatic hydrocarbons or may be directly subjected to further separation, e.g. by distillation, to provide different purified product streams. Such purified product stream may include a benzene product stream, a toluene product stream, a xylene product stream and/or an ethylbenzene product stream. A further petrochemical product that is preferably produced by the process of the present invention includes olefins, preferably C2-C4 olefins.

Preferably, the aromatic ring opening further produces light-distillate and wherein the BTX is recovered from said light-distillate. Preferably, the BTX produced by aromatic ring opening is comprised in the light-distillate. In this embodiment, the BTX comprised in the light-distillate is separated from the other hydrocarbons comprised in said light-distillate by the BTX recovery.

Preferably, the BTX is recovered from the pyrolysis gasoline and/or from the light-distillate by subjecting said pyrolysis gasoline and/or light-distillate to hydrocracking. By selecting hydrocracking for the BTX recovery, the BTX yield of the process of the present invention can be improved since mono-aromatic hydrocarbons other than BTX can be converted into BTX by hydrocracking.

Preferably, pyrolysis gasoline is hydrotreated before subjecting to hydrocracking to saturate all olefins and diolefins. By removing the olefins and diolefins in the pyrolysis gasoline, the exotherm during hydrocracking can be better controlled, thus improving operability. More preferably, the olefins and diolefins are separated from the pyrolysis gasoline using conventional methods such as described in U.S. Pat. No. 7,019,188 and WO 01/59033 A1. Preferably, the olefins and diolefins, which were separated from the pyrolysis gasoline, are subjected to aromatization, thereby improving the BTX yield of the process of the present invention.

The process of the present invention may involve hydrocracking, which comprises contacting the pyrolysis gasoline and preferably the light-distillate in the presence of hydrogen with a hydrocracking catalyst under hydrocracking conditions. The process conditions useful hydrocracking, also described herein as "hydrocracking conditions", can be easily determined by the person skilled in the art; see Alfke et al. (2007) loc.cit. Preferably, the pyrolysis gasoline is subjected to gasoline hydrotreatment as described herein above before subjecting to hydrocracking. Preferably, the C9+ hydrocarbons comprised in the hydrocracked product stream are recycled to aromatic ring opening.

The term "hydrocracking" is used herein in its generally accepted sense and thus may be defined as a catalytic cracking process assisted by the presence of an elevated partial pressure of hydrogen; see e.g. Alfke et al. (2007) loc.cit. The products of this process are saturated hydrocarbons and, depending on the reaction conditions such as temperature, pressure and space velocity and catalyst activity, aromatic hydrocarbons including BTX. The process conditions used for hydrocracking generally includes a process temperature of 200-600° C., elevated pressures of 0.2-20 MPa, space velocities between 0.1-20 $h^{-1}$. Hydrocracking reactions proceed through a bifunctional mechanism which requires an acid function, which provides for the cracking and isomerization and which provides breaking and/or rearrangement of the carbon-carbon bonds comprised in the hydrocarbon compounds comprised in the feed, and a hydrogenation function. Many catalysts used for the hydrocracking process are formed by combining various transition metals, or metal sulfides with the solid support such as alumina, silica, alumina-silica, magnesia and zeolites.

Preferably the BTX is recovered from the pyrolysis gasoline and/or from the light-distillate by subjecting said pyrolysis gasoline and/or light-distillate to gasoline hydrocracking. As used herein, the term "gasoline hydrocracking" or "GHC" refers to a hydrocracking process that is particularly suitable for converting a complex hydrocarbon feed that is relatively rich in aromatic hydrocarbon compounds—such as pyrolysis gasoline—to LPG and BTX, wherein said process is optimized to keep one aromatic ring intact of the aromatics comprised in the GHC feedstream, but to remove most of the side-chains from said aromatic ring. Accordingly, the main product produced by gasoline hydrocracking is BTX and the process can be optimized to provide chemicals-grade BTX. Preferably, the hydrocarbon feed that is subject to gasoline hydrocracking further comprises light-distillate. More preferably, the hydrocarbon feed that is subjected to gasoline hydrocracking preferably does not comprise more than 1 wt-% of hydrocarbons having more than one aromatic ring. Preferably, the gasoline hydrocracking conditions include a temperature of 300-580° C., more preferably of 400-580° C. and even more preferably of 430-530° C. Lower temperatures must be avoided since hydrogenation of the aromatic ring becomes favourable, unless a specifically adapted hydrocracking catalyst is employed. For instance, in case the catalyst comprises a further element that reduces the hydrogenation activity of the catalyst, such as tin, lead or bismuth, lower temperatures may be selected for gasoline hydrocracking; see e.g. WO 02/44306 A1 and WO 2007/055488. In case the reaction temperature is too high, the yield of LPG's (especially propane and butanes) declines and the yield of methane rises. As the catalyst activity may decline over the lifetime of the catalyst, it is advantageous to increase the reactor temperature gradually over the life time of the catalyst to maintain the hydrocracking conversion rate. This means that the optimum temperature at the start of an operating cycle preferably is at the lower end of the hydrocracking temperature range. The optimum reactor temperature will rise as the catalyst deactivates so that at the end of a cycle (shortly before the catalyst is replaced or regenerated) the temperature preferably is selected at the higher end of the hydrocracking temperature range.

Preferably, the gasoline hydrocracking of a hydrocarbon feedstream is performed at a pressure of 0.3-5 MPa gauge, more preferably at a pressure of 0.6-3 MPa gauge, particularly preferably at a pressure of 1-2 MPa gauge and most preferably at a pressure of 1.2-1.6 MPa gauge. By increasing reactor pressure, conversion of C5+ non-aromatics can be increased, but this also increases the yield of methane and the hydrogenation of aromatic rings to cyclohexane species which can be cracked to LPG species. This results in a reduction in aromatic yield as the pressure is increased and, as some cyclohexane and its isomer methylcyclopentane, are not fully hydrocracked, there is an optimum in the purity of the resultant benzene at a pressure of 1.2-1.6 MPa.

Preferably, gasoline hydrocracking of a hydrocarbon feedstream is performed at a Weight Hourly Space Velocity (WHSV) of 0.1-20 $h^{-1}$, more preferably at a Weight Hourly Space Velocity of 0.2-15 $h^{-1}$ and most preferably at a Weight Hourly Space Velocity of 0.4-10 $h^{-1}$. When the space velocity is too high, not all BTX co-boiling paraffin components are hydrocracked, so it will not be possible to achieve BTX specification by simple distillation of the reactor product. At too low space velocity the yield of methane rises at the expense of propane and butane. By selecting the optimal Weight Hourly Space Velocity, it was surprisingly found that sufficiently complete reaction of the benzene co-boilers is achieved to produce on spec BTX without the need for a liquid recycle.

Preferably, the hydrocracking comprises contacting the pyrolysis gasoline and preferably the light-distillate in the presence of hydrogen with a hydrocracking catalyst under hydrocracking conditions, wherein the hydrocracking catalyst comprises 0.1-1 wt-% hydrogenation metal in relation to the total catalyst weight and a zeolite having a pore size of 5-8 Å and a silica ($SiO_2$) to alumina ($Al_2O_3$) molar ratio of 5-200 and wherein the hydrocracking conditions comprise a temperature of 400-580° C., a pressure of 300-5000 kPa gauge and a Weight Hourly Space Velocity (WHSV) of 0.1-20 $h^{-1}$. The hydrogenation metal preferably is at least one element selected from Group 10 of the periodic table of Elements, most preferably Pt. The zeolite preferably is MFI. Preferably a temperature of 420-550° C., a pressure of 600-3000 kPa gauge and a Weight Hourly Space Velocity of 0.2-15 $h^{-1}$ and more preferably a temperature of 430-530° C., a pressure of 1000-2000 kPa gauge and a Weight Hourly Space Velocity of 0.4-10 $h^{-1}$ is used.

One advantage of selecting this specific hydrocracking catalyst as described herein above is that no desulphurization of the feed to the hydrocracking is required.

Accordingly, preferred gasoline hydrocracking conditions thus include a temperature of 400-580° C., a pressure of 0.3-5 MPa gauge and a Weight Hourly Space Velocity of 0.1-20 $h^{-1}$. More preferred gasoline hydrocracking conditions include a temperature of 420-550° C., a pressure of 0.6-3 MPa gauge and a Weight Hourly Space Velocity of 0.2-15 $h^{-1}$. Particularly preferred gasoline hydrocracking conditions include a temperature of 430-530° C., a pressure of 1-2 MPa gauge and a Weight Hourly Space Velocity of 0.4-10 $h^{-1}$.

Preferably, the aromatic ring opening and preferably the hydrocracking further produce LPG and wherein said LPG is subjected to aromatization to produce BTX.

The process of the present invention may involve aromatization, which comprises contacting the LPG with an aromatization catalyst under aromatization conditions. The process conditions useful for aromatization, also described herein as "aromatization conditions", can be easily determined by the person skilled in the art; see Encyclopedia of Hydrocarbons (2006) Vol II, Chapter 10.6, p. 591-614.

By subjecting some or all of the LPG produced by hydrocracking to aromatization, the aromatics yield of the integrated process can be improved. In addition thereto, hydrogen is produced by said aromatization, which can be used as a feed for the hydrogen consuming processes such as the aromatic ring opening and/or the aromatics recovery.

The term "aromatization" is used herein in its generally accepted sense and thus may be defined as a process to convert aliphatic hydrocarbons to aromatic hydrocarbons. There are many aromatization technologies described in the prior art using C3-C8 aliphatic hydrocarbons as raw material; see e.g. U.S. Pat. No. 4,056,575; U.S. Pat. No. 4,157,356; U.S. Pat. No. 4,180,689; Micropor. Mesopor. Mater 21, 439; WO 2004/013095 A2 and WO 2005/000851 A1. Accordingly, the aromatization catalyst may comprise a zeolite, preferably selected from the group consisting of ZSM-5 and zeolite L and may further comprising one or more elements selected from the group consisting of Ga, Zn, Ge and Pt. In case the feed mainly comprises C3-C5 aliphatic hydrocarbons, an acidic zeolite is preferred. As used herein, the term "acidic zeolite" relates to a zeolite in its default, protonic form. In case the feed mainly comprises C6-C8 hydrocarbons a non-acidic zeolite preferred. As used herein, the term "non-acidic zeolite" relates to a zeolite that is base-exchanged, preferably with an alkali metal or alkaline earth metals such as cesium, potassium, sodium, rubidium, barium, calcium, magnesium and mixtures thereof, to reduce acidity. Base-exchange may take place during synthesis of the zeolite with an alkali metal or alkaline earth metal being added as a component of the reaction mixture or may take place with a crystalline zeolite before or after deposition of a noble metal. The zeolite is base-exchanged to the extent that most or all of the cations associated with aluminum are alkali metal or alkaline earth metal. An example of a monovalent base:aluminum molar ratio in the zeolite after base exchange is at least about 0.9. Preferably, the catalyst is selected from the group consisting of HZSM-5 (wherein HZSM-5 describes ZSM-5 in its protonic form), Ga/HZSM-5, Zn/HZSM-5 and Pt/GeHZSM-5. The aromatization conditions may comprise a temperature of 400-600° C., preferably 450-550° C., more preferably 480-520° C. a pressure of 100-1000 kPa gauge, preferably 200-500 kPa gauge, and a Weight Hourly Space Velocity (WHSV) of 0.1-20 $h^{-1}$, preferably of 0.4-4 $h^{-1}$.

Preferably, the aromatization comprises contacting the LPG with an aromatization catalyst under aromatization conditions, wherein the aromatization catalyst comprises a zeolite selected from the group consisting of ZSM-5 and zeolite L, optionally further comprising one or more elements selected from the group consisting of Ga, Zn, Ge and Pt and wherein the aromatization conditions comprise a temperature of 400-600° C., preferably 450-550° C., more preferably 480-520° C. a pressure of 100-1000 kPa gauge, preferably 200-500 kPa gauge, and a Weight Hourly Space Velocity (WHSV) of 0.1-20 $h^{-1}$, preferably of 0.4-4 $h^{-1}$.

Preferably, the pyrolysis further produces LPG and wherein said LPG produced by pyrolysis is subjected to aromatization to produce BTX.

Preferably, only part of the LPG produced in the process of the present invention (e.g. produced by one or more selected from the group consisting of aromatic ring opening, hydrocracking and pyrolysis) is subjected to aromatization to produce BTX. The part of the LPG that is not subjected to aromatization may be subjected to olefins synthesis, e.g. by subjecting to pyrolysis or, preferably, to dehydrogenation.

Preferably, propylene and/or butylenes are separated from the LPG produced by pyrolysis before subjecting to aromatization.

Means and methods for separating propylene and/or butylenes from mixed C2-C4 hydrocarbon streams are well known in the art and may involve distillation and/or extraction; see Ullmann's Encyclopedia of Industrial Chemistry, Vol. 6, Chapter "Butadiene", 388-390 and Vol. 13, Chapter "Ethylene", p. 512.

Preferably, some or all of the C2 hydrocarbons are separated from LPG produced in the process of the present invention before subjecting said LPG to aromatization.

Some or all of the C2-C4 paraffins may be recycled to the pyrolysis or to the aromatization. By changing the proportion of the C2-C4 paraffins may be recycled to the pyrolysis or to the aromatization the aromatics yield and the olefins yield of the process of the present invention can be adapted, which improves the overall hydrogen balance of the overall process.

Preferably, the LPG produced by hydrocracking and aromatic ring opening is subjected to a first aromatization that is optimized towards aromatization of paraffinic hydrocarbons. Preferably, said first aromatization preferably comprises the aromatization conditions comprising a temperature of 450-550° C., preferably 480-520° C., a pressure of 100-1000 kPa gauge, preferably 200-500 kPa gauge, and a Weight Hourly Space Velocity (WHSV) of 0.1-7 $h^{-1}$, preferably of 0.4-2 $h^{-1}$. Preferably, the LPG produced by pyrolysis is subjected to a second aromatization that is optimized towards aromatization of olefinic hydrocarbons. Preferably, said second aromatization preferably comprises the aromatization conditions comprising a temperature of 400-600° C., preferably 450-550° C., more preferably 480-520° C., a pressure of 100-1000 kPa gauge, preferably 200-700 kPa gauge, and a Weight Hourly Space Velocity (WHSV) of 1-20 $h^{-1}$, preferably of 2-4 $h^{-1}$.

It was found that the aromatic hydrocarbon product made from olefinic feeds may comprise less benzene and more xylenes and C9+ aromatics than the liquid product resulting from paraffinic feeds. A similar effect may be observed when the process pressure is increased. It was found that olefinic aromatization feeds are suitable for higher pressure operation when compared to an aromatization process using paraffinic hydrocarbon feeds, which results in a higher conversion. With respect to paraffinic feed and low pressure process, the detrimental effect of pressure on aromatics selectivity may be offset by the improved aromatic selectivities for olefinic aromatization feeds.

Preferably, one or more of the group consisting of pyrolysis, hydrocracking and aromatic ring opening, and optionally aromatization further produce methane and wherein said methane is used as fuel gas to provide process heat. Preferably, said fuel gas may be used to provide process heat to the pyrolysis, hydrocracking, aromatic ring opening and/or aromatization.

Preferably, the pyrolysis and/or the aromatization further produce hydrogen and wherein said hydrogen is used in the hydrocracking and/or aromatic ring opening.

Figure 2:
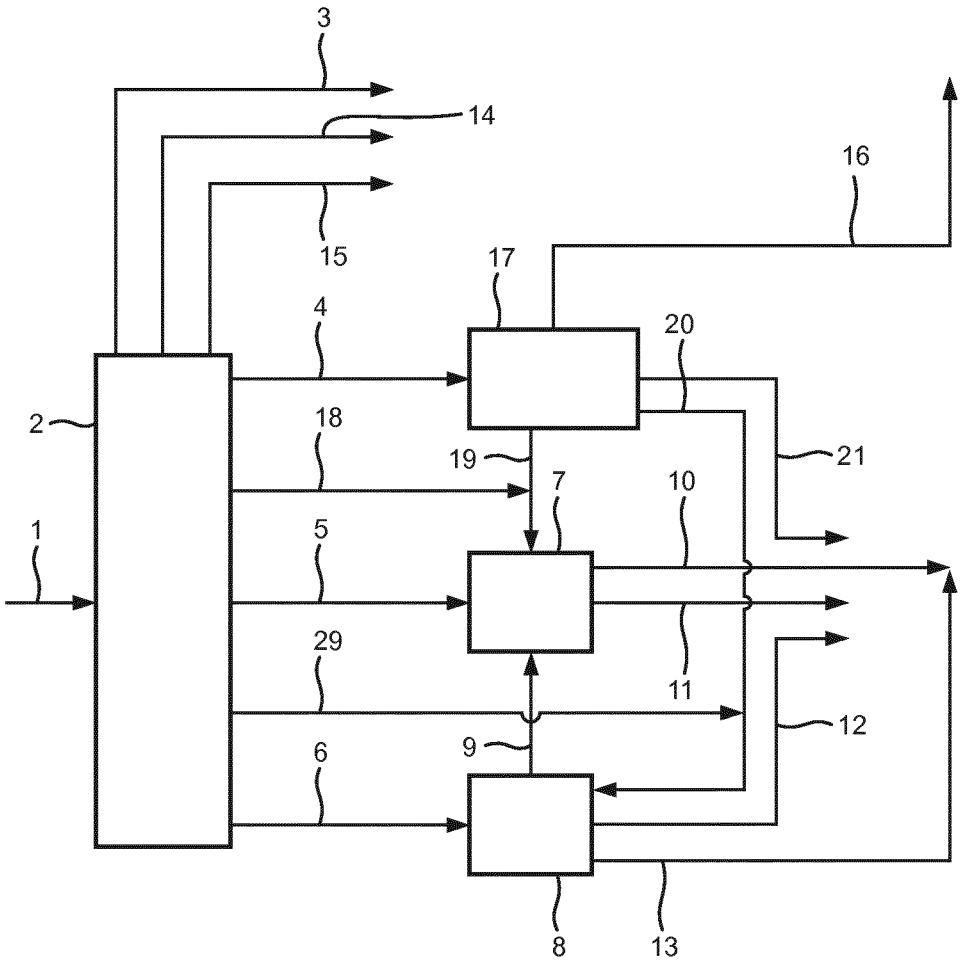
FIG. 2 is a flow scheme illustrating of an embodiment according to the present invention.
Figure 3:
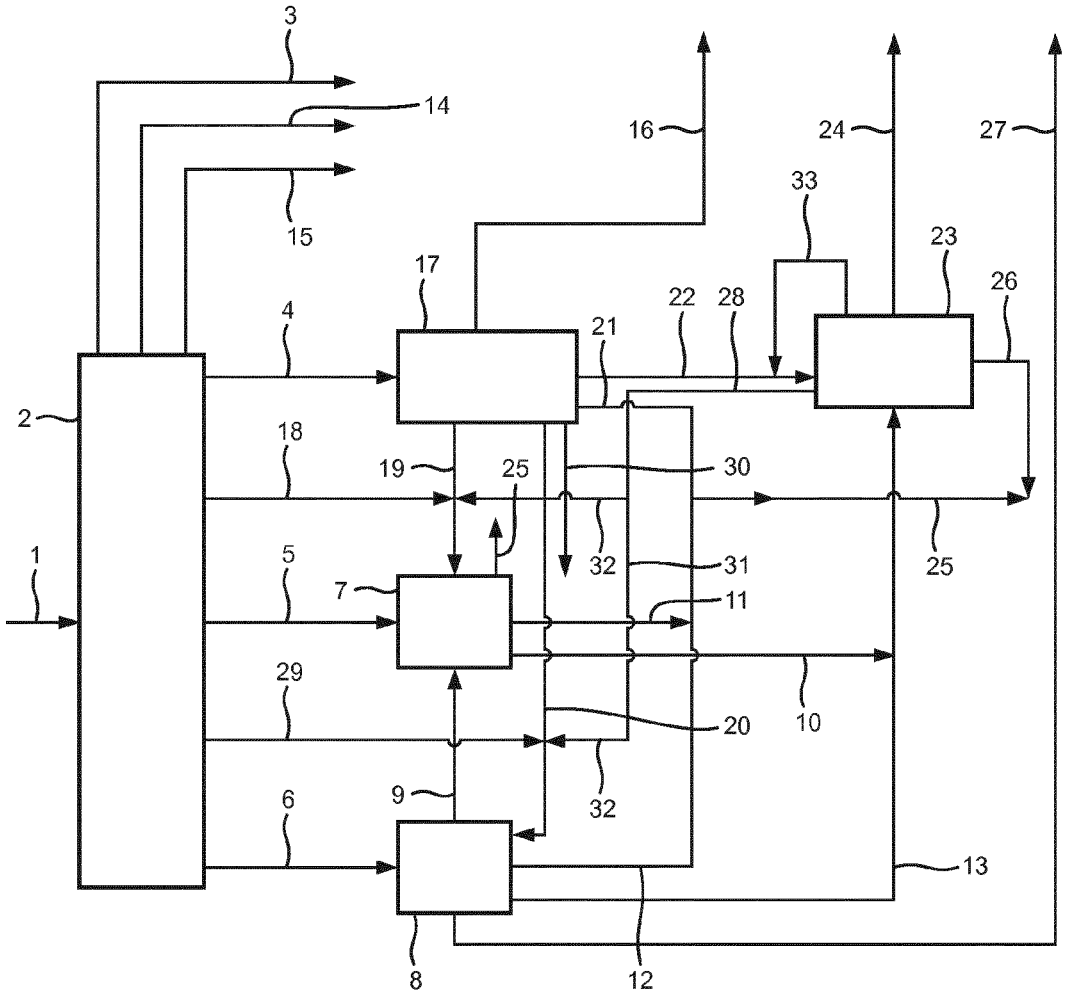
FIG. 3 is a flow scheme illustrating of an embodiment according to the present invention.

A representative process flow scheme illustrating particular embodiments for carrying out the process of the present invention is described in FIGS. 1-3. FIG. 1-3 are to be understood to present an illustration of the invention and/or the principles involved.

In a further aspect, the present invention also relates to a process installation suitable for performing the process of the invention. This process installation and the process as performed in said process installation is particularly presented in FIGS. 1-3 (FIGS. 1-3).

Accordingly, the present invention provides a process installation for producing BTX comprising a pyrolysis unit (2) comprising an inlet for a pyrolysis feedstream (1) and an outlet for pyrolysis gasoline (5) and an outlet for C9+ hydrocarbons (6);

an aromatic ring opening unit (8) comprising an inlet for C9+ hydrocarbons (6) and an outlet for BTX (12); and a BTX recovery unit (7) comprising an inlet for pyrolysis gasoline (5) and an outlet for BTX (12).

This aspect of the present invention is presented in FIG. 1 (FIG. 1).

As used herein, the term "an inlet for X" or "an outlet of X", wherein "X" is a given hydrocarbon fraction or the like relates to an inlet or outlet for a stream comprising said hydrocarbon fraction or the like. In case of an outlet for X is directly connected to a downstream refinery unit comprising an inlet for X, said direct connection may comprise further units such as heat exchangers, separation and/or purification units to remove undesired compounds comprised in said stream and the like.

If, in the context of the present invention, a unit is fed with more than one feed stream, said feedstreams may be combined to form one single inlet into the unit or may form separate inlets to the unit.

The aromatic ring opening unit (8) preferably further has an outlet for light-distillate (9) which is fed to the BTX recovery unit (7). The BTX produced in the aromatic ring opening unit (8) may be separated from the light-distillate to form an outlet for BTX (12). Preferably, the BTX produced in the aromatic ring opening unit (8) is comprised in the light-distillate (9) and is separated from said light-distillate in the BTX recovery unit (7).

The pyrolysis unit (2) preferably further has an outlet for fuel gas (3) and/or an outlet for LPG (4). Preferably, the pyrolysis unit (2) further has an outlet for ethylene (14) and/or an outlet for butadiene (15). Preferably, the pyrolysis unit (2) further has an outlet for hydrogen that is fed to aromatic ring opening (29) and/or an outlet for hydrogen that is fed to BTX recovery (18). The aromatic ring opening unit (8) preferably further has an outlet for fuel gas (27) and/or an outlet for LPG (13). The BTX recovery unit (7) preferably further comprises an outlet for fuel gas (25) and/or an outlet for LPG (10).

Preferably, the process installation of the present invention further comprises an aromatization unit (17) comprising an inlet for LPG (4) and an outlet for BTX produced by aromatization (21).

This aspect of the present invention is presented in FIG. 2 (FIG. 2).

The LPG fed to the aromatization unit (17) is preferably produced by the pyrolysis unit (2), but may also be produced by other units such as the aromatic ring opening unit (8) and/or the BTX recovery unit (7). The aromatization unit (17) preferably further comprises an outlet for fuel gas (16) and/or an outlet for LPG (22).

Preferably, the aromatization unit (17) further comprises an outlet for hydrogen that is fed to the aromatic ring opening unit (20) and/or an outlet for hydrogen that is fed to the BTX recovery unit (19).

Preferably, the process installation of the present invention further comprises a second aromatization unit (23) in addition to the first aromatization unit (17), wherein said second aromatization unit (23) comprises an inlet for LPG produced by aromatic ring opening unit (13) and/or for LPG produced by the BTX recovery unit (10) and an outlet for BTX produced by the second aromatization unit (26). This aspect of the present invention is presented in FIG. 3 (FIG. 3).

The second aromatization unit (23) preferably further comprises an inlet for LPG produced by the first aromatization unit (22). The second aromatization unit (23) preferably further comprises an outlet for fuel gas (24) and/or an outlet for LPG (33) that is preferably recycled to said second aromatization unit (23). Furthermore, the second aromatization unit (23) preferably further comprises an outlet for hydrogen (28). This hydrogen produced by the second aromatization unit (23) is preferably fed to aromatic ring opening unit (8) via line (31) and/or the BTX recovery unit (7) via line (32). The first aromatization unit (17) and/or the second aromatization unit (23) may further produce C9+ hydrocarbons, as illustrated by outlet (30). Such C9+ hydrocarbons are preferably fed to the aromatic ring opening (8).

The following numeral references are used in FIGS. 1-3:

1 pyrolysis feedstream
2 pyrolysis unit
3 fuel gas produced by pyrolysis
4 LPG produced by pyrolysis
5 pyrolysis gasoline
6 C9+ hydrocarbons produced by pyrolysis
7 BTX recovery unit
8 aromatic ring opening unit
9 light-distillate produced by aromatic ring opening
10 LPG produced by BTX recovery
11 BTX produced by BTX recovery
12 BTX produced by aromatic ring opening
13 LPG produced by aromatic ring opening
14 ethylene produced by pyrolysis
15 butadiene
16 fuel gas produced by (first) aromatization
17 (first) aromatization unit
18 hydrogen produced by pyrolysis that is fed to BTX recovery
19 hydrogen produced by (first) aromatization that is fed to BTX recovery
20 hydrogen produced by (first) aromatization that is fed to aromatic ring opening
21 BTX produced by (first) aromatization
22 LPG produced by first aromatization
23 second aromatization unit
24 fuel gas produced by second aromatization
25 fuel gas produced by BTX recovery
26 BTX produced by second aromatization
27 fuel gas produced by aromatic ring opening
28 hydrogen produced by second aromatization
29 hydrogen produced by pyrolysis that is fed to aromatic ring opening
30 C9+ hydrocarbons produced by (first) aromatization
31 hydrogen produced by second aromatization that is fed to aromatic ring opening
32 hydrogen produced by second aromatization that is fed to BTX recovery
33 LPG produced by second aromatization It is noted that the invention relates to all possible combinations of features described herein, particularly features recited in the claims.

It is further noted that the term 'comprising' does not exclude the presence of other elements. However, it is also to be understood that a description on a product comprising certain components also discloses a product consisting of these components. Similarly, it is also to be understood that a description on a process comprising certain steps also discloses a process consisting of these steps.

The present invention will now be more fully described by the following non-limiting Examples.

EXAMPLE 1 (COMPARATIVE)

The experimental data as provided herein were obtained by flowsheet modelling in Aspen Plus. The steam cracking kinetics were taken into account rigorously (software for steam cracker product slate calculations). The following steam cracker furnace conditions were applied: ethane and propane furnaces: COT (Coil Outlet temperature)=845° C. and steam-to-oil-ratio=0.37, C4-furnaces and liquid furnaces: Coil Outlet temperature=820° C. and Steam-to-oil-ratio=0.37.

For the aromatics recovery section a reaction scheme has been used in which alkylbenzenes are transformed into BTX and LPG, naphthenic species are dehydrogenated into monoaromatics and paraffinic compounds were converted into LPG.

In Example 1, Light Virgin naphtha is sent to the steam cracker operating under the abovementioned conditions and the pyrolysis gasoline generated by that unit is further upgraded in the aromatics recovery section. The results are provided in table 1 as provided herein below.

The products that are generated are divided into petrochemicals (olefins and BTXE, which is an acronym for BTX+ethylbenzene) and other products (hydrogen, methane and heavy fractions comprising C9 and heavier aromatic compounds). The hydrogen generated by the steam cracker (hydrogen-producing unit) can be subsequently used in the hydrogen-consuming units (pygas treatment unit)

For the Example 1 the BTXE yield is 12 wt-% of the total feed.

EXAMPLE 2

Example 2 is identical to the Example 1 except for the following:

The C9+ fraction generated by the steam cracker is subjected to aromatic ring opening that is operated under process conditions to maintain 1 aromatic ring. The effluent from the aromatic ring opening unit is further treated in a GHC unit to yield BTX (product) and LPG (co-product). The results are provided in table 1 as provided herein below.

For Example 2 the BTXE yield is 13.5 wt-% of the total feed.

EXAMPLE 3

Example 3 is identical to the Example 2 except for the following:

A middle-distillate stream originating from Arabian Light crude oil is used as feedstock to the steam cracker. The use of a heavier and more aromatic feedstock (26% aromatics compared to 5% found in Light Virgin naphtha) increases the BTXE production at the expense of larger hydrogen consumption: while in Example 2 the production and consumption of hydrogen is in balance, in Example 3 there is a shortage of 2.2 wt-% of total feed. The battery-limit product yields are provided in table 1 as provided herein below.

For Example 3 the BTXE yield is 24.4 wt-% of the total feed.

EXAMPLE 4

Example 4 is identical to the Example 2 except for the following:

An aromatization process is treating the C3 and C4 hydrocarbons (except butadiene) generated by the steam cracker, the aromatics recovery unit and the aromatic ring opening unit. Different yield patterns due to variations in feedstock composition (e.g. olefinic content) were obtained from literature and applied in the model to determine the battery-limit product slate (Table 1). A remarkable increase in BTXE yield is obtained with a simultaneous increase in the hydrogen production. In overall terms, there is a surplus of hydrogen of 1 wt-% of total feed.

For Example 4 the BTXE yield is 31.3 wt-% of the total feed.

EXAMPLE 5

Example 5 is identical to the Example 4 except for the following:

A middle-distillate stream originating from Arabian Light crude oil is used as feedstock to the steam cracker. This feedstock is the same as used in Example 3. In overall terms, there is a shortage of hydrogen of 1.4 wt-% of total feed.

For Example 5 the BTXE yield is 39.0 wt-% of the total feed.

TABLE 1

Battery-limit product slates

| PRODUCTS | Example 1 wt-% of feed | Example 2 wt-% of feed | Example 3 wt-% of feed | Example 4 wt-% of feed | Example 5 wt-% of feed |
|---|---|---|---|---|---|
| H2* | 1.1% | 1.1% | 0.9% | 2.1% | 1.8% |
| CH4 | 15.6% | 15.6% | 12.2% | 19.4% | 27.7% |
| Ethylene | 30.3% | 30.3% | 27.7% | 30.3% | 0.0% |
| Ethane | 3.8% | 4.2% | 3.9% | 8.0% | 7.3% |
| Propylene | 17.9% | 17.9% | 13.8% | 0.1% | 0.1% |
| Propane | 5.5% | 6.7% | 7.5% | 1.6% | 1.8% |
| 1-butene | 1.7% | 1.7% | 1.5% | 0.0% | 0.0% |
| i-butene | 3.4% | 3.4% | 1.6% | 0.0% | 0.0% |
| butadiene | 4.8% | 4.8% | 4.7% | 4.8% | 4.7% |
| n-butane | 0.3% | 0.7% | 1.7% | 0.0% | 0.0% |
| i-butane | 0.0% | 0.0% | 0.0% | 0.0% | 0.0% |
| GASES | 84.5% | 86.5% | 75.6% | 66.4% | 59.1% |
| Benzene | 8.7% | 9.0% | 10.7% | 13.4% | 14.4% |
| Toluene | 2.8% | 3.4% | 7.8% | 12.1% | 14.9% |
| Xylenes | 0.4% | 0.9% | 4.8% | 3.3% | 6.6% |
| EB | 0.1% | 0.2% | 1.2% | 2.6% | 3.0% |
| BTXE | 12.0% | 13.5% | 24.4% | 31.3% | 39.0% |
| C9 AROMATICS | 3.5% | 0.0% | 0.0% | 2.3% | 1.9% |

*Hydrogen amounts shown in Table 1 represent hydrogen produced in the system and not battery-limit product slate. The result of the overall hydrogen balance can be found in each example.

The invention claimed is:

1. A process for producing BTX comprising:

(a) subjecting a pyrolysis feedstream comprising hydrocarbons to pyrolysis to produce pyrolysis gasoline and C9+ hydrocarbons;

(b) subjecting C9+ hydrocarbons to aromatic ring opening to produce BTX; and (c) recovering BTX from pyrolysis gasoline, wherein the pyrolysis further produces LPG and wherein said LPG produced by pyrolysis is subjected to aromatization to produce BTX.

2. The process according to claim 1, wherein the aromatic ring opening further produces light-distillate and wherein the BTX is recovered from said light-distillate.

3. The process according to claim 1, wherein the BTX is recovered from the pyrolysis gasoline and/or from the light-distillate by subjecting said pyrolysis gasoline and/or light-distillate to hydrocracking.

4. The process according to claim 1, wherein the aromatic ring opening and the hydrocracking further produce LPG and wherein said LPG is subjected to aromatization to produce BTX.

5. The process according to claim 3, wherein the aromatic ring opening further produces light-distillate and wherein the BTX is recovered from said light-distillate.

6. The process according to claim 5, wherein propylene and/or butylenes are separated from the LPG produced by pyrolysis before subjecting to aromatization.

7. The process according to claim 1, wherein said pyrolysis comprises heating the pyrolysis feedstream in the presence of steam to a temperature of 750-900° C. with residence time of 50-1000 milliseconds at a pressure of atmospheric to 175 kPa gauge.

8. The process according to claim 3, wherein said hydrocracking comprises contacting the pyrolysis gasoline and the light-distillate in the presence of hydrogen with a hydrocracking catalyst under hydrocracking conditions, wherein the hydrocracking catalyst comprises 0.1-1 wt-% hydrogenation metal in relation to the total catalyst weight and a zeolite having a pore size of 5-8 Å and a silica ($SiO_2$) to alumina ($Al_2O_3$) molar ratio of 5-200 and wherein the hydrocracking conditions comprise a temperature of 400-580° C., a pressure of 300-5000 kPa gauge and a Weight Hourly Space Velocity (WHSV) of 0.1-20 $h^{-1}$.

9. The process according to claim 1, wherein said aromatic ring opening comprises contacting the C9+ hydrocarbons in the presence of hydrogen with an aromatic ring opening catalyst under aromatic ring opening conditions, wherein the aromatic ring opening catalyst comprises a transition metal or metal sulphide component and a support and wherein the aromatic ring opening conditions comprise a temperature of 100-600° C., a pressure of 1-12 MPa.

10. The process according to claim 9, wherein the aromatic ring opening catalyst comprises an aromatic hydrogenation catalyst comprising one or more elements selected from the group consisting of Ni, W and Mo on a refractory support; and a ring cleavage catalyst comprising a transition metal or metal sulphide component and a support and wherein the conditions for aromatic hydrogenation comprise a temperature of 100-500° C., a pressure of 2-10 MPa and the presence of 1-30 wt-% of hydrogen in relation to the hydrocarbon feedstock and wherein the ring cleavage comprises a temperature of 200-600° C., a pressure of 1-12 MPa and the presence of 1-20 wt-% of hydrogen in relation to the hydrocarbon feedstock.

11. The process according to claim 4, wherein the aromatization comprises contacting the LPG with an aromatization catalyst under aromatization conditions, wherein the aromatization catalyst comprises a zeolite selected from the group consisting of ZSM-5 and zeolite L, optionally further comprising one or more elements selected from the group consisting of Ga, Zn, Ge and Pt and wherein the aromatization conditions comprise a temperature of 400-600° C., a pressure of 100-1000 kPa gauge and a Weight Hourly Space Velocity (WHSV) of 0.1-20 $h^{-1}$.

12. The process according to claim 4, wherein the LPG produced by hydrocracking and aromatic ring opening is subjected to a first aromatization that is optimized towards aromatization of paraffinic hydrocarbons, wherein said first aromatization comprises the aromatization conditions comprising a temperature of 400-600° C., a pressure of 100-1000 kPa gauge and a Weight Hourly Space Velocity (WHSV) of 0.1-7 $h^{-1}$; and/or wherein the LPG produced by pyrolysis is subjected to a second aromatization that is optimized towards aromatization of olefinic hydrocarbons, wherein said second aromatization comprises the aromatization conditions comprising a temperature of 400-600° C., a pressure of 100-1000 kPa gauge and a Weight Hourly Space Velocity (WHSV) of 1-20 $h^{-1}$.

13. The process according to claim 1, wherein one or more of the group consisting of the pyrolysis, the hydrocracking and the aromatic ring opening, and optionally the aromatization, further produce methane and wherein said methane is used as fuel gas to provide process heat.

14. The process according to claim 1, wherein the pyrolysis feedstream comprises naphtha.

15. The process according to claim 1, wherein the pyrolysis and/or the aromatization further produce hydrogen and wherein said hydrogen is used in the hydrocracking and/or the aromatic ring opening.

16. The process according to claim 9, wherein the support comprises one or more elements selected from the group consisting of Pd, Rh, Ru, Ir, Os, Cu, Co, Ni, Pt, Fe, Zn, Ga, In, Mo, W and V in metallic or metal sulphide form supported on an acidic solid.

17. The process according to claim 16, wherein the support is selected from the group consisting of alumina, silica, alumina-silica and zeolites.

18. The process according to claim 14, wherein the pyrolysis feedstream comprises paraffinic naphtha or straight run naphtha.

19. The process according to claim 2, wherein the aromatic ring opening and the hydrocracking further produce LPG and wherein said LPG is subjected to aromatization to produce BTX.

20. The process according to claim 9, wherein the aromatic ring opening and the hydrocracking further produce LPG and wherein said LPG is subjected to aromatization to produce BTX.

* * * * *